US005833546A

United States Patent [19]

Wang

[11] Patent Number: 5,833,546

[45] Date of Patent: Nov. 10, 1998

[54] KNOCKDOWN GOLF TRAINING APPARATUS IN THE FORM OF A BILLIARD TABLE

[76] Inventor: Chih Chiang Wang, 2F., No. 3, Lane 280, Chung-Chan Rd., Hsin Tien City,Taipei Hsien, Taiwan

[21] Appl. No.: 923,000

[22] Filed: Sep. 9, 1997

[51] Int. Cl.[6] ..... A63D 15/00

[52] U.S. Cl. ..... 473/3

[58] Field of Search ..... 473/3, 31, 32

[56] References Cited

U.S. PATENT DOCUMENTS

| | | | |
|---|---|---|---|
| 723,378 | 3/1903 | Fuller | 473/3 |
| 747,716 | 12/1903 | How | 473/3 |
| 2,809,040 | 10/1957 | Trovato | 473/31 |
| 3,138,387 | 6/1964 | Michel | 473/31 |
| 4,579,342 | 4/1986 | Mortensen | 473/3 |
| 4,957,288 | 9/1990 | Kantner | 473/3 |

*Primary Examiner*—Theatrice Brown

*Attorney, Agent, or Firm*—Pro-Techtor International Services

[57] ABSTRACT

Disclosed is a knockdown golf training site in the form of a billiard table formed from a plurality of frame members assembled with a plurality of side and corner ball cavities and a ground carpet onto which the assembled frame members and ball cavities are detachably attached. The knockdown golf training site can be easily disassembled and packed in the ground carpet to be conveniently stored on a car, so that it can be carried to be assembled for use outdoors at any time either for practicing putting golf balls into holes or for conducting a billiard game with golf balls and clubs.

2 Claims, 5 Drawing Sheets

KNOCKDOWN GOLF TRAINING APPARATUS IN THE FORM OF A BILLIARD TABLE

BACKGROUND OF THE INVENTION

The present invention relates to a golf training site, and more particularly to a knockdown golf training site in the form of a billiard table which can be easily assembled at any place for practicing golf or playing billiards.

A most common golf practice means available in the market is an elongated golf ball path provided with an artificial-grass-covered top surface and a hole at a far end of the path. Such golf practice means is usually designed only for practicing putting and has short path and small volume for use indoors. It fails to give a user the same feeling as playing golf outdoors and will lose its attraction to the user after it has been monotonously used to practice putting for a long time. The above conventional golf practice means might be laid aside when it no longer attracts the user.

SUMMARY OF THE INVENTION

It is therefore a primary object of the present invention to provide a knockdown golf training site in the form of a billiard table. The golf training site according to the present invention provides an adequate area for a user to practice putting a golf ball into hole from different directions and at different angles.

Another object of the present invention is to provide a knockdown golf training site in the form of a billiard table, so that it can be used not only to practice putting but also to play billiards with golf balls and clubs, if desired, to provide more funs to the user.

A further object of the present invention is to provide a knockdown golf training site in the form of a billiard table which can be easily assembled at any place for use and be easily disassembled for convenient carrying and storage.

BRIEF DESCRIPTION OF THE DRAWINGS

The means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention relates to a knockdown golf training site in the form of a billiard table and is mainly formed from one or more side ball cavities 1, one or more corner ball cavities 2, a plurality of frame members, and a ground carpet 4 or similar material.

Figure 1:
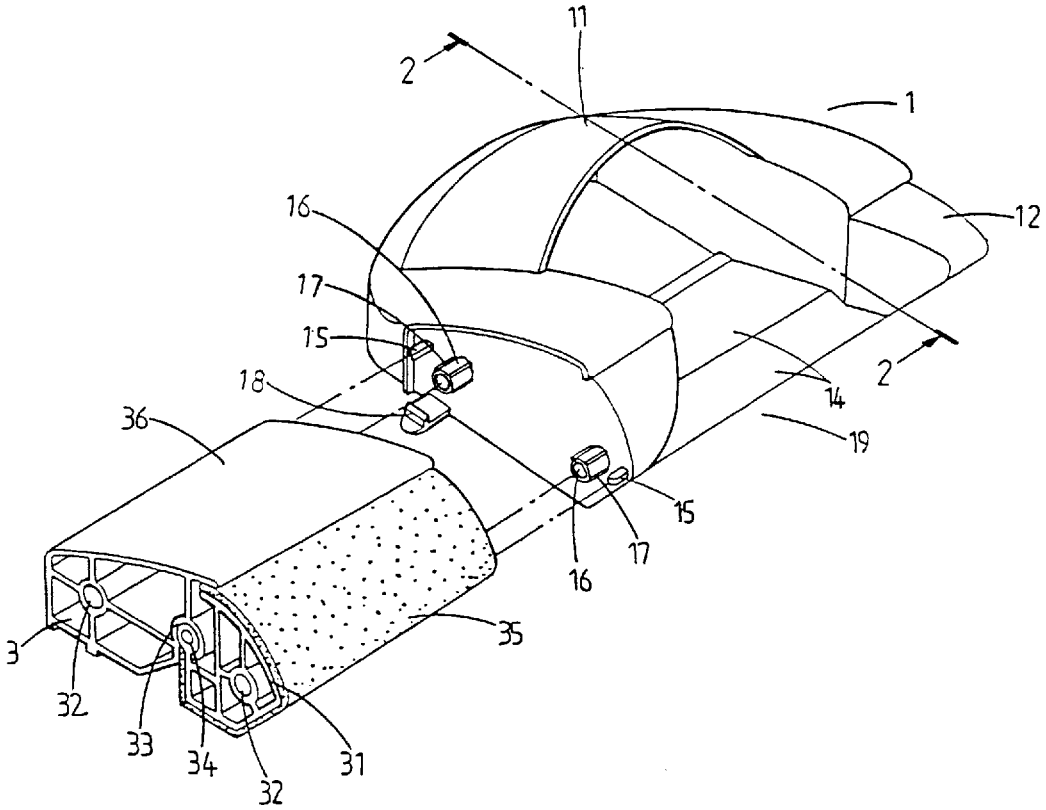
FIG. 1 illustrates the manner in which a side ball cavity is assembled to a length of frame member for the golf training site.
Figure 2:
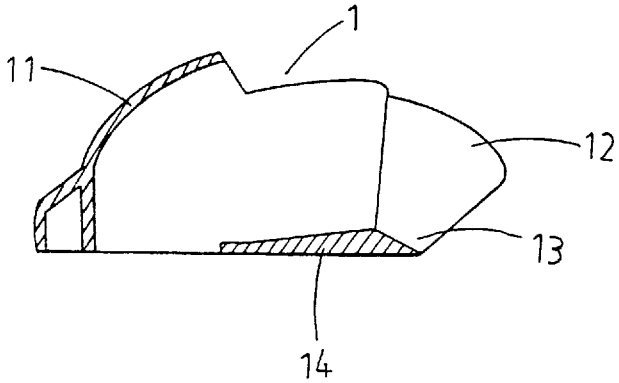
FIG. 2 is a sectional view taken on line 2—2 of FIG. 1.

FIG. 1 illustrates the side ball cavity 1 and a short length of the frame member of the present invention in a perspective form. FIG. 2 is a sectional view of the side ball cavity 1 taken on line 2—2 of FIG. 1. As shown, the side ball cavity 1 includes an arched top cover 11, and a curved side portion 12 defining a space below the top cover 11 and an inlet 19 in front of the top cover 11. The inlet 19 is provided at a front bottom with a slightly raised portion 13 which includes a front and a back outward inclined surface 14. The curved side portion 12 is provided on each outer side wall at predetermined positions with a front and a rear insertion rod 16 having a plurality of axially extended compression ribs 17 spaced on a circumferential surface thereof, as well as a front and a rear projected block 15 respectively located in front of the front insertion rod and behind the rear insertion rod 16. Moreover, a retaining hook 18 is provided below the rear insertion rod 16.

Figure 4:
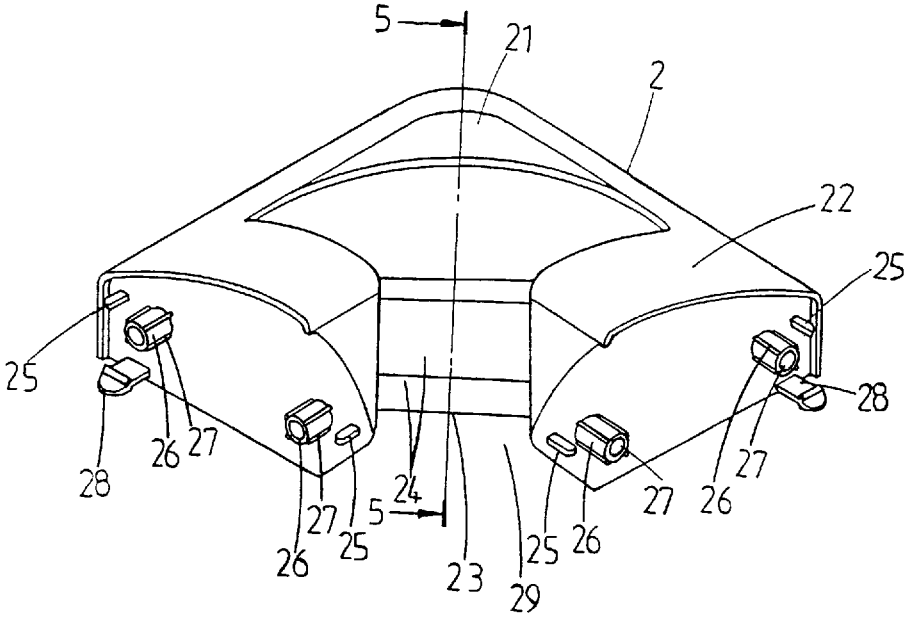
FIG. 4 is a perspective showing a corner ball cavity of the present invention.
Figure 5:
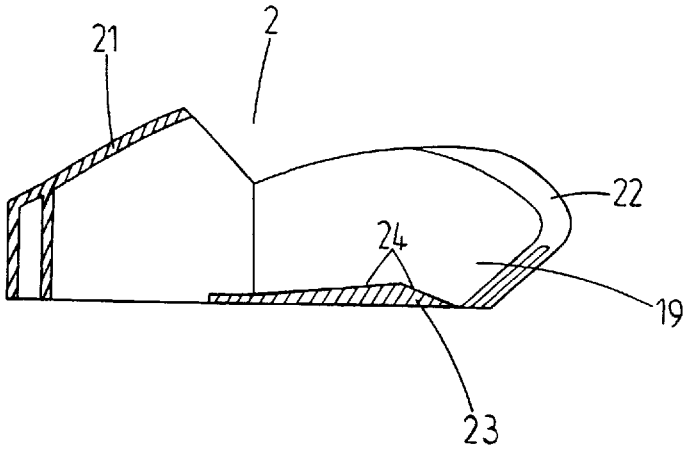
FIG. 5 is a sectional view taken on line 5—5 of FIG. 4.

FIG. 4 illustrates the corner ball cavity 2 of the present invention and FIG. 5 is a sectional view of the corner ball cavity 2 taken on line 5—5 of FIG. 4. As shown, the corner ball cavity 2 includes an arched top cover 21 and an angular side wall portion 22 defining a space below the top cover 21 and an inlet 29 in front of the top cover 21. The inlet 29 is provided at a front bottom with a slightly raised portion 23 which includes a front and a back outward inclined surface 24. The angular side portion 22 is provided on each outer side wall at predetermined positions with a front and a rear insertion rod 26 having a plurality of axially extended compression ribs 27 spaced on a circumferential surface thereof, as well as a front and a rear projected block 25 respectively located in front of the front insertion rod and behind the rear insertion rod 26. Moreover, a retaining hook 28 is provided below the rear insertion rod 26.

Figure 3:
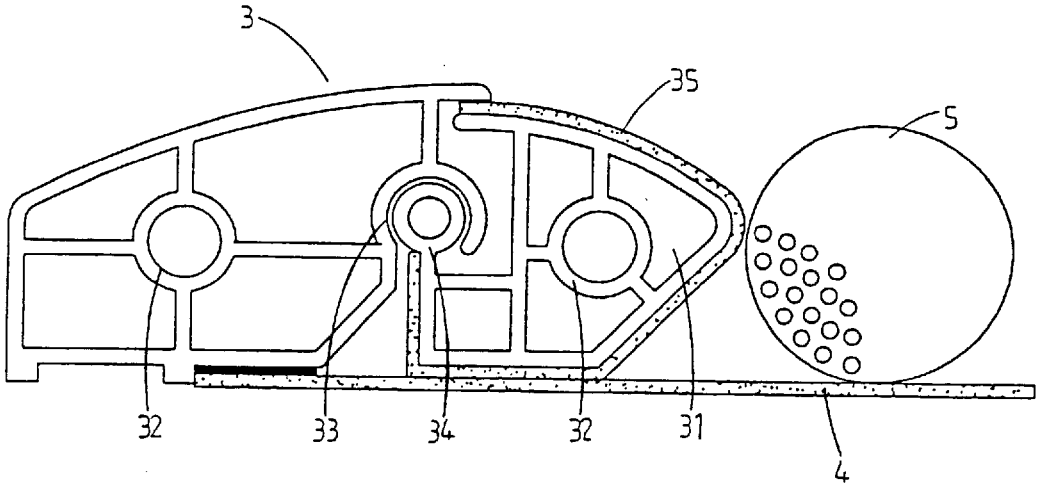
FIG. 3 is a sectional view of the frame member of the present invention.

Please refer to FIGS. 1, 2 and 3 for the structure of the frame member of the present invention. As shown, each length of the frame member includes an outside frame member 3 and an inside frame member 31. Both the outside and the inside frame members 3, 31 are hollow members with specially designed webs to support an insertion hole 32 corresponding to the insertion rods 16, 26. The outside frame member 3 is provided at a side facing the inside frame member 31 with an axially extended channel 33 having a round section, and the inside frame member 31 is provided at a side facing the outside frame member 3 with an axially extended strip 34 having a round section corresponding to the round channel 33. The outside frame member 3 and the inside frame member 31 are associated with one another by engaging the round strip 34 into the round channel 33. An outer surface of the inside frame member 31 is covered with a layer of elastic material 35.

The ground carpet 4 is made of elastic material having a top surface imitating natural grass. To the top of the ground carpet 4, side ball cavities 1, corner ball cavities 2, and associated outside and inside frame members 3, 31 are detachably attached.

Figure 6:
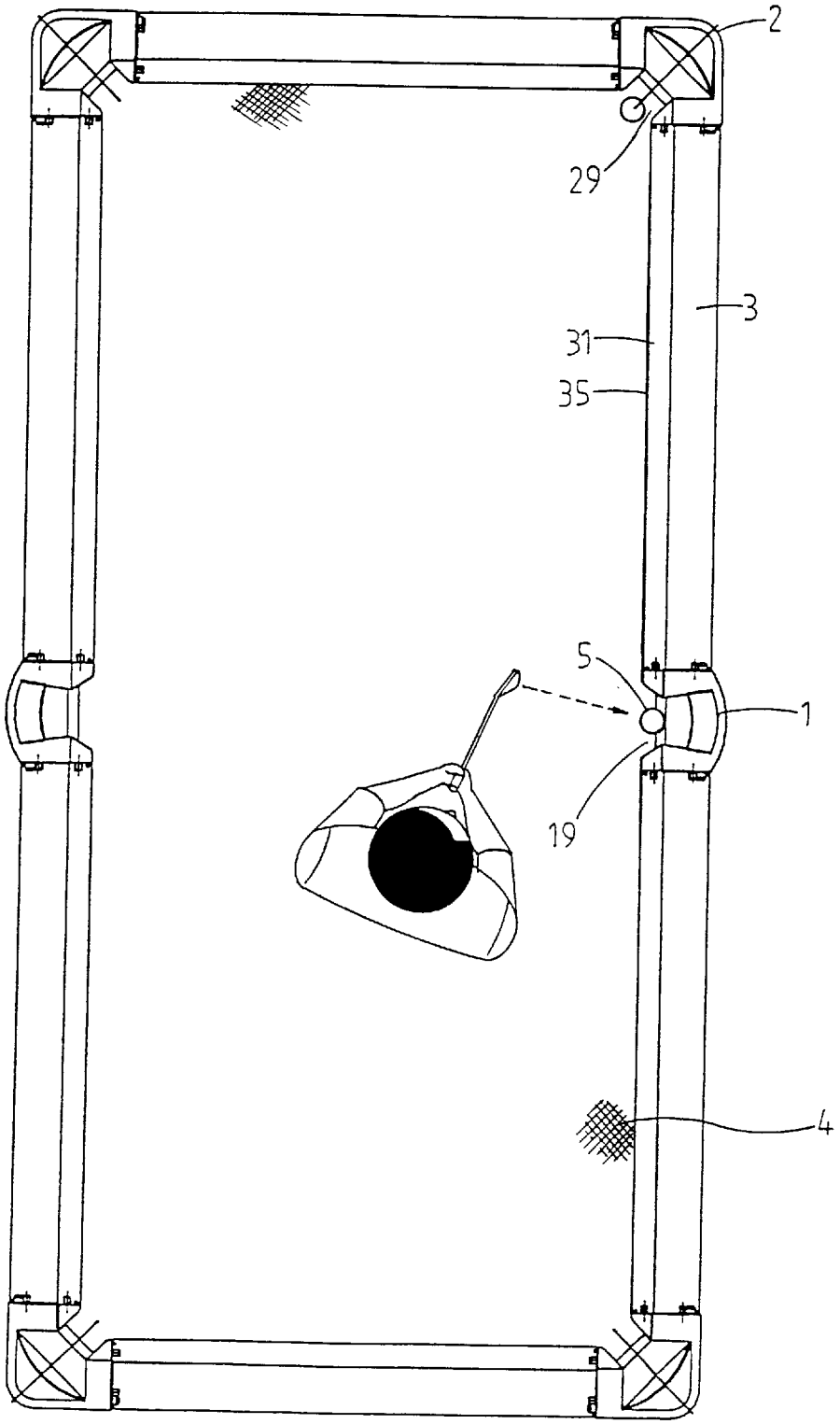
FIG. 6 illustrates an assembled golf training site according to the present invention.

FIG. 6 illustrates an embodiment of the present invention. In this embodiment, two side ball cavities 1, four corner ball cavities 2, and six sets of associated outside and inside frame members 3, 31 are assembled to form a golf training site in the form of a billiard table. To assemble the ball cavities 1 and 2 to the frame members 3, 31, simply permit the front and the rear insertion rods 16, 26 to align with and thereby insert into the insertion holes 32 on the outside and the inside frame members 3, 31. At this point, the front and the rear projected blocks 15, 25 shall just press against inner wall surfaces of the outside and the inside frame members 3, 31 and the retaining hooks 18, 28 shall hook to holes formed on the outside frame members 3 to further engage the outside and the inside frame members 3, 31 with the ball cavities 1, 2. Velcro tapes 6 are provided to a bottom side of each outside frame member 3 and along a top periphery of the ground carpet 4 to connect the ground carpet 4 to the assembled frame members and ball cavities.

The angular side wall portion 22 of the corner ball cavity 2 may contain an angle of 120°, 90°, 60°, 45° or 30°. Use corner ball cavities 2 containing a particular angle to cooperate with the side ball cavities 1 and the frame members as well as a ground carpet 4 having a desired shape, a quadrilateral, pentagonal, hexagonal, or octagonal golf training site can be formed as desired.

The golf training site according to the present invention is detachably assembled from the ball cavities 1, 2, the frame members 3, 31, and the ground carpet 4. The whole golf training site can be easily disassembled and all the ball cavities and the frame members can be packed in the ground carpet 4 for convenient storage on and carry by a car for use outdoors at any time either as a golf training site or as a billiard table.

Figure 7:
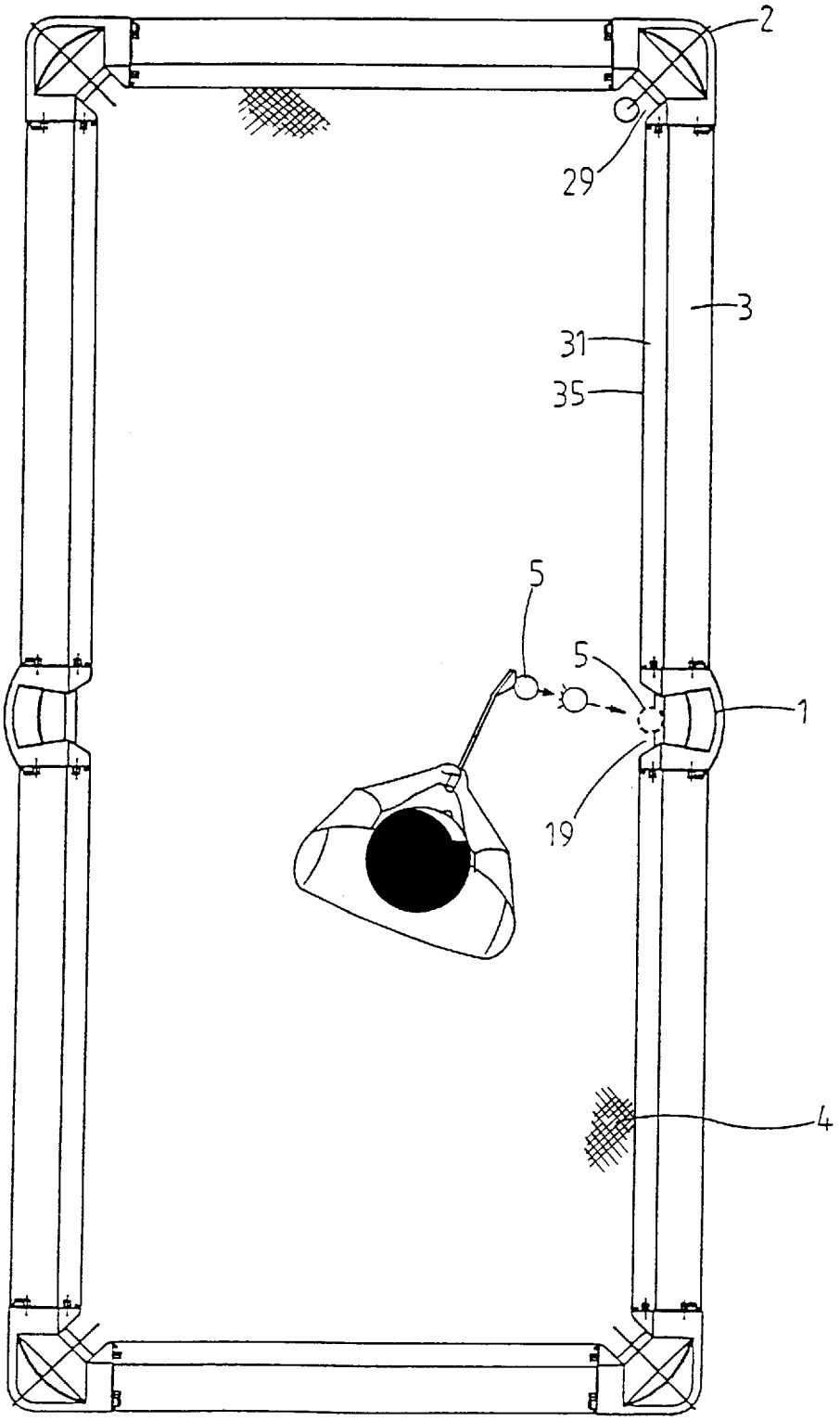
FIG. 7 illustrates a golfer is practicing putting on the golf training site of the present invention.

As shown in FIG. 7, a user may use the present invention to practice putting a golf ball 5 into a ball cavity 1 or 2. Or, the user may use a golf club to strike golf balls 5 following the rules of playing billiards. Many different games based on golf or billiards can be designed by the user to play on the present invention, making the present invention more practical and interesting for use.

What is claimed is:

1. A knockdown golf training site in the form of a billiard table, comprising a plurality of frame members, side ball cavities, corner ball cavities, and a ground carpet;

said side ball cavity-each including a top cover and a curve side wall portion and said corner ball cavity each including a top cover and an angular side wall portion, said curve and angular side wall portions defining a cavity below said top covers and an inlet in front of said covers, said inlet each having a slightly raised front bottom formed from a front and a rear outward inclined surface, said curve and said angular side wall portions both being provided at each outer side wall surface at predetermined positions with a front and a rear insertion rod having compression ribs axially spaced on circumferential surfaces thereof, a front projected block in front of said front insertion rod, a rear projected block behind said rear insertion rod, and a retaining hook below said rear insertion rod;

said frame member each including an outside frame member and an inside frame member, both said outside and said inside frame members being hollow members with specially designed webs to support an insertion hole corresponding to said insertion rods provided on said ball cavities, said outside frame member being provided at a side facing said inside frame member with an axially extended channel having a round section, and said inside frame member being provided at a side facing said outside frame member with an axially extended strip having a round section corresponding to said round channel, such that said outside frame member and said inside frame member are associated with one another by engaging said round strip into said round channel, and an outer surface of said inside frame member being covered with a layer of elastic material and a bottom side of said outside frame member being covered with a layer of velcro tape; and said ground carpet being made of elastic material having a top surface imitating natural grass and being provided along a top periphery with velcro tape to detachably connect with said velcro tape on said outside frame member;

whereby said front and said rear insertion rods on said ball cavities can be aligned with and inserted into said insertion holes on said outside and said inside frame members with said front and said rear projected blocks just pressing against inner wall surfaces of said outside and said inside frame members and said retaining hooks hooking to holes formed on said outside frame members, so as to assemble a plurality of said frame members and said ball cavities together, and whereby said frame members assembled with said ball cavities can be associated with said ground carpet by attaching said velcro tape on bottom of said frame members to said velcro tape on top periphery of said ground carpet to form a golf training site in the form of a billiard table.

2. A knockdown golf training site in the form of a billiard table as claimed in claim 1, wherein said angular side wall portion of said corner ball cavity contains an angle which can be selected from 120°, 90°, 60°, 45°, or 30°.

* * * * *